US008235690B2

(12) United States Patent
Sakamoto et al.

(10) Patent No.: US 8,235,690 B2
(45) Date of Patent: Aug. 7, 2012

(54) SCROLL COMPRESSOR WITH IMPROVED OIL SEPARATION FROM REFRIGERANT GAS

(75) Inventors: Yasuo Sakamoto, Gunma-ken (JP); Yoshiaki Koike, Ota (JP); Satoshi Iitsuka, Ota (JP); Kazuyoshi Sugimoto, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 358 days.

(21) Appl. No.: 12/405,543

(22) Filed: Mar. 17, 2009

(65) Prior Publication Data

US 2009/0238704 A1 Sep. 24, 2009

(30) Foreign Application Priority Data

Mar. 19, 2008 (JP) ..... 2008-071164
Mar. 19, 2008 (JP) ..... 2008-071180
Mar. 19, 2008 (JP) ..... 2008-071207

(51) Int. Cl.
*F03C 4/00* (2006.01)
*F04C 18/00* (2006.01)
*F04C 2/00* (2006.01)

(52) U.S. Cl. ... 418/55.6; 418/100; 418/270; 418/DIG. 1

(58) Field of Classification Search ..... 418/55.1–55.6, 418/57, 270, 88, 94, 100, DIG. 1
See application file for complete search history.

(56) References Cited

FOREIGN PATENT DOCUMENTS

| | | | |
|---|---|---|---|
| JP | 62126288 A | * | 6/1987 |
| JP | 6-47993 | | 6/1994 |
| JP | 2000161268 A | * | 6/2000 |
| JP | 2001329978 A | * | 11/2001 |
| JP | 2004100662 A | * | 4/2004 |
| KR | 2004107721 A | * | 12/2004 |

OTHER PUBLICATIONS

JP 2004100662 A, Onuma et al., Scroll Compressor, Apr. 2, 2004—English Translation.*
KR 2004107721 A, Bae, High vacuum prevention device of scroll compressor by using gas guide pipe communicating with gas passage for moving backward compressed gas of exhaust space into intake space and disposing outlet of gas guide pipe near onverload, Dec. 23, 2004—English Translation.*

* cited by examiner

*Primary Examiner* — Theresa Trieu
(74) *Attorney, Agent, or Firm* — Kratz, Quintos & Hanson, LLP

(57) ABSTRACT

There is disclosed a scroll compressor capable of improving the oil separating device of a refrigerant gas discharged from a scroll compression element to effectively suppress the amount of oil to be discharged through a discharge tube. The scroll compressor has, in a sealed container, a scroll compression element, a motor element which drives the scroll compression element, and a support frame having a bearing portion which keeps a shaft of the motor element, and provided with a communication path. The scroll compressor further includes a shield plate which extends from the support frame to the motor element side to surround the periphery of the bearing portion, and a guide member provided at an outlet of the communication path to guide the discharged gas in the direction of the shield plate.

2 Claims, 15 Drawing Sheets

SCROLL COMPRESSOR WITH IMPROVED OIL SEPARATION FROM REFRIGERANT GAS

BACKGROUND OF THE INVENTION

The present invention relates to a scroll compressor in which a motor element and a scroll compression element driven by the motor element are received in a vertical type sealed container and in which a refrigerant sucked through a suction tube connected to an end cap constituting the sealed container is compressed by the scroll compression element to discharge the refrigerant through a discharge tube connected to a container main body constituting the sealed container.

Heretofore, this type of scroll compressor has a constitution in which an electric motor (a motor element constituted of a motor) and a scroll compression element driven by this electric motor are received in a vertical type sealed container and in which a refrigerant sucked through a suction tube connected to an end cap constituting the sealed container is compressed by the scroll compression element to discharge the refrigerant through a discharge tube connected to a cylindrical container main body.

The scroll compressor is provided with a guide passage which guides a compressed gas discharged to a discharge chamber provided in the upper part of the sealed container, to the outer peripheral surface of a coil end provided above the motor element. This guide passage is formed of a frame having a U-shaped section and the inner surface of the sealed container. On the outlet side of the guide passage is provided a deflection plate which changes the flow direction of a refrigerant gas circulated through the guide passage so as to discharge the gas to the outer peripheral surface of a coil end portion.

Moreover, the refrigerant gas discharged from the scroll compression element to the discharge chamber descends along a communication path, is guided to the upper part of a motor element, flows into the guide passage in the frame, and then collides with the deflection plate. In consequence, the flow direction of the descending refrigerant gas is deflected, and the gas is discharged from the opening of the guide passage on an outlet side to the outer peripheral surface of the coil end portion of the motor element. In this case, the area of the outlet-side opening is set to an area larger than that of the guide passage, whereby the outflow velocity of oil and the gas is lowered to improve an oil separating function. The oil included in the refrigerant gas is collected by the coil end portion (see Examined Patent Application Publication No. 06-47993 (Patent Document 1)).

However, in the conventional technology in which the area of the outlet-side opening is set to the area larger than that of the guide passage to lower the outflow velocity of the oil and the gas and improve the oil separating function, thereby collecting the oil included in the refrigerant gas by the coil end portion, since the area of the outlet-side opening is simply set to the area larger than that of the guide passage, the separation efficiency of the oil included in the refrigerant gas has its limits. In consequence, there has been a problem that the oil is discharged through the discharge tube after all.

The present invention has been developed to solve such a problem of the conventional technology, and an object thereof is to provide a scroll compressor capable of improving the oil separating function of a refrigerant gas discharged from a scroll compression element to effectively suppress the amount of oil to be discharged through a discharge tube.

SUMMARY OF THE INVENTION

A scroll compressor according to a first aspect of the present invention comprises, in a sealed container, a scroll compression element; a motor element which drives the scroll compression element; and a support frame having a bearing portion which keeps a shaft of the motor element, the scroll compression element including a fixed scroll in which a spiral lap is vertically provided on the surface of a mirror plate and a orbit scroll which is revolved by the shaft of the motor element with respect to this fixed scroll to vertically provide a spiral lap on one face of the mirror plate, both the laps being engaged with each other to form a plurality of compression spaces, each compression space being gradually reduced from the outside to the inside so that a gas sucked through a suction tube connected to the compression space of the outer peripheral portion of the scroll compressor is compressed, discharged into the sealed container on a fixed scroll side from the center of the compression element, guided to the side of the motor element through a communication path provided in the support frame, and discharged through a discharge tube connected to the sealed container in the vicinity of the bearing portion, the scroll compressor characterized by further comprising: a shield plate which extends from the support frame to the motor element side to surround the periphery of the bearing portion; and a guide member provided at an outlet of the communication path to guide the discharged gas in the direction of the shield plate.

The scroll compressor according to a second aspect of the present invention is characterized in that the present invention of the first aspect further comprises: an overcurrent protection apparatus for the motor element attached to a coil end of a stator constituting the motor element, and the overcurrent protection apparatus is positioned in a gas path which extends from the communication path outside the shield plate to the discharge tube.

The scroll compressor according to a third aspect of the present invention is characterized in that in addition to the first aspect of the present invention, the support frame has a plurality of seat portions to attach the support frame to the sealed container, and oil separation members are attached so as to cover the seat portions, respectively.

The scroll compressor according to a fourth aspect of the present invention is characterized in that in addition to the third aspect of the present invention, the oil separation members are covered with an air-permeable insulating material.

According to the first aspect of the present invention, the scroll compressor comprises, in the sealed container, the scroll compression element, the motor element which drives the scroll compression element and the support frame having the bearing portion which keeps the shaft of the motor element, the scroll compression element including the fixed scroll in which the spiral lap is vertically provided on the surface of the mirror plate and the orbit scroll which is revolved by the motor element with respect to this fixed scroll to vertically provide the spiral lap on the one face of the mirror plate, both the laps being engaged with each other to form the plurality of compression spaces, each compression space being gradually reduced from the outside to the inside so that the gas sucked through the suction tube connected to the compression space of the outer peripheral portion of the scroll compressor is compressed, discharged into the sealed container on the fixed scroll side from the center of the scroll compressor, guided to the side of the motor element through the communication path provided in the support frame, and discharged through the discharge tube connected to the sealed container in the vicinity of the bearing portion. The scroll compressor further comprises: the shield plate which extends from the support frame to the motor element side to surround the periphery of the bearing portion. Therefore, this shield plate can effectively suppress a disadvantage that oil which has flowed from the bearing portion is discharged through the discharge tube.

Moreover, the shield plate can suppress a disadvantage that the gas guided from the communication path to the motor element side is rotated by the rotation of the motor element. In consequence, it is possible to suppress a disadvantage that the oil separated from the gas remains on the inner surface of the sealed container, moves toward the discharge tube, and is discharged through the discharge tube owing to the centrifugal force generated by the rotation of the gas.

In particular, since the scroll compressor includes the guide member provided at the outlet of the communication path to guide the discharged gas in the direction of the shield plate, the gas guided from the communication path to the motor element side is blown to the shield plate by the guide member, thereby promoting the separation of the oil from the gas. In general, according to the present invention, the amount of the oil to be discharged through the discharge tube can effectively be decreased.

According to the second aspect of the present invention, the present invention of the first aspect further comprises the overcurrent protection apparatus for the motor element attached to the coil end of the motor element, and the overcurrent protection apparatus is positioned in the gas path which extends from the communication path outside the shield plate to the discharge tube. Therefore, the gas guided to the motor element side through the communication path and passing through the guide path outside the shield plate toward the discharge tube collides with the overcurrent protection apparatus provided in the motor element. Owing to such collision with the overcurrent protection apparatus, the oil in the gas is further effectively separated, so that the amount of the oil to be discharged through the discharge tube can further be suppressed.

According to the third aspect of the present invention, in addition to the first aspect of the present invention, the support frame has the plurality of seat portions to attach the support frame to the sealed container, and the oil separation members are attached so as to cover the seat portions, respectively. Therefore, the gas guided from the communication path to the motor element side and directed to the discharge tube smoothly flows into the oil separation members which cover the seat portions of the support frame positioned in the gas path.

Consequently, while the gas passes through the oil separation members, the oil in the gas is separated, so that the amount of the oil to be discharged through the discharge tube can effectively be decreased.

In particular, since the plurality of oil separation members are attached by use of the plurality of seat portions of the support frame, respectively, the oil in the gas is separated by the plurality of oil separation members, and a generally remarkable oil separation effect can be achieved.

According to the fourth aspect of the present invention, in addition to the third aspect of the present invention, since the oil separation members are covered with the air-permeable insulating material, insulation between the oil separation members and the motor element is performed without any trouble.

DETAILED DESCRIPTION OF THE PREFERRED EMBODIMENT

The present invention is mainly characterized in that the oil separation efficiency of a refrigerant gas discharged from a scroll compression element, which has been limited, is further improved to effectively decrease the amount of oil to be discharged through a discharge tube. A shield plate which extends from a support frame to a motor element side to surround the periphery of a bearing portion is provided to realize a purpose of decreasing the amount of the oil to be discharged through the discharge tube.

(Embodiment 1)

Figure 1:
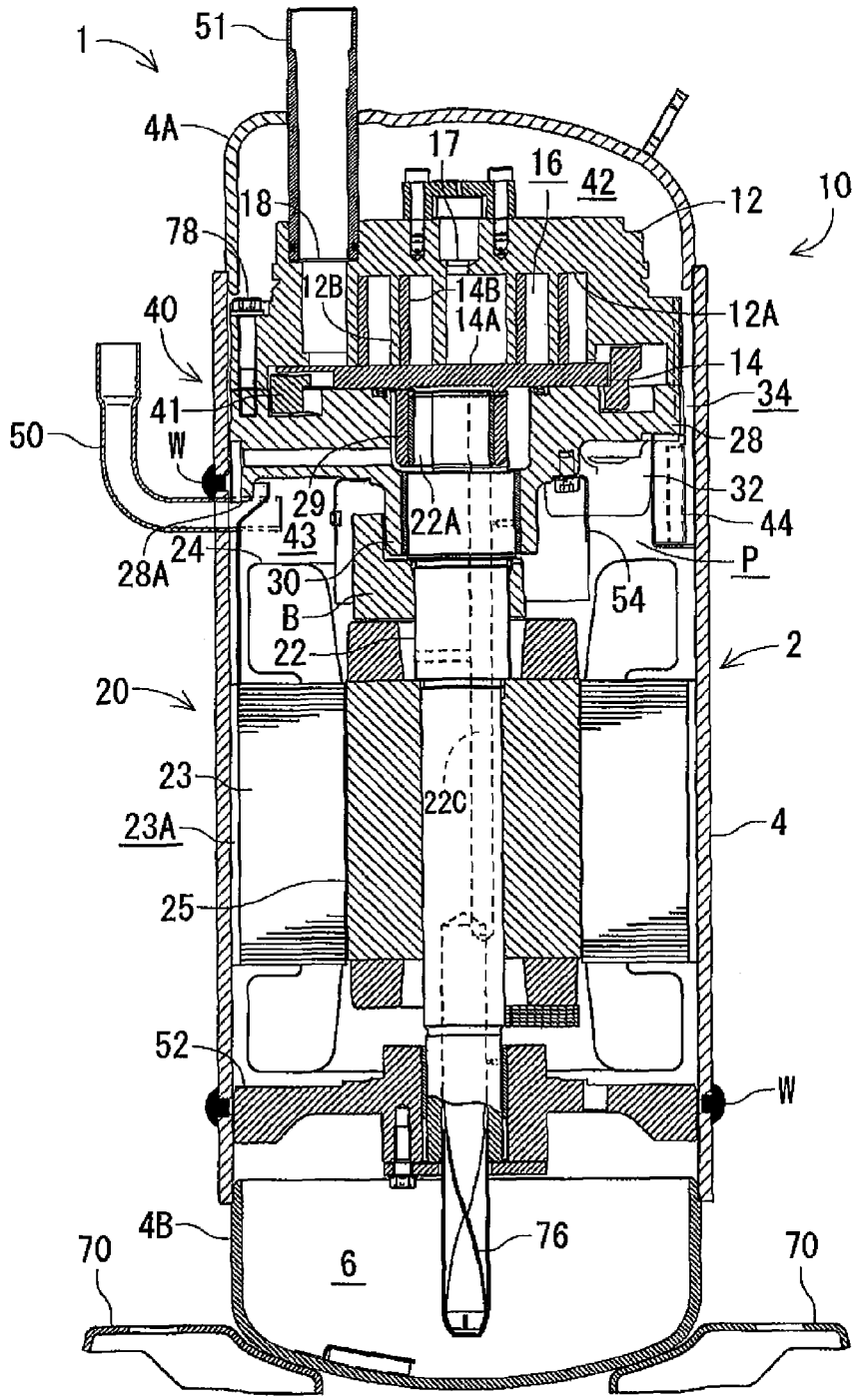
FIG. 1 is a vertical side view of an internal high pressure type scroll compressor including a scroll compression element, showing Embodiment 1 of the present invention.
Figure 2:
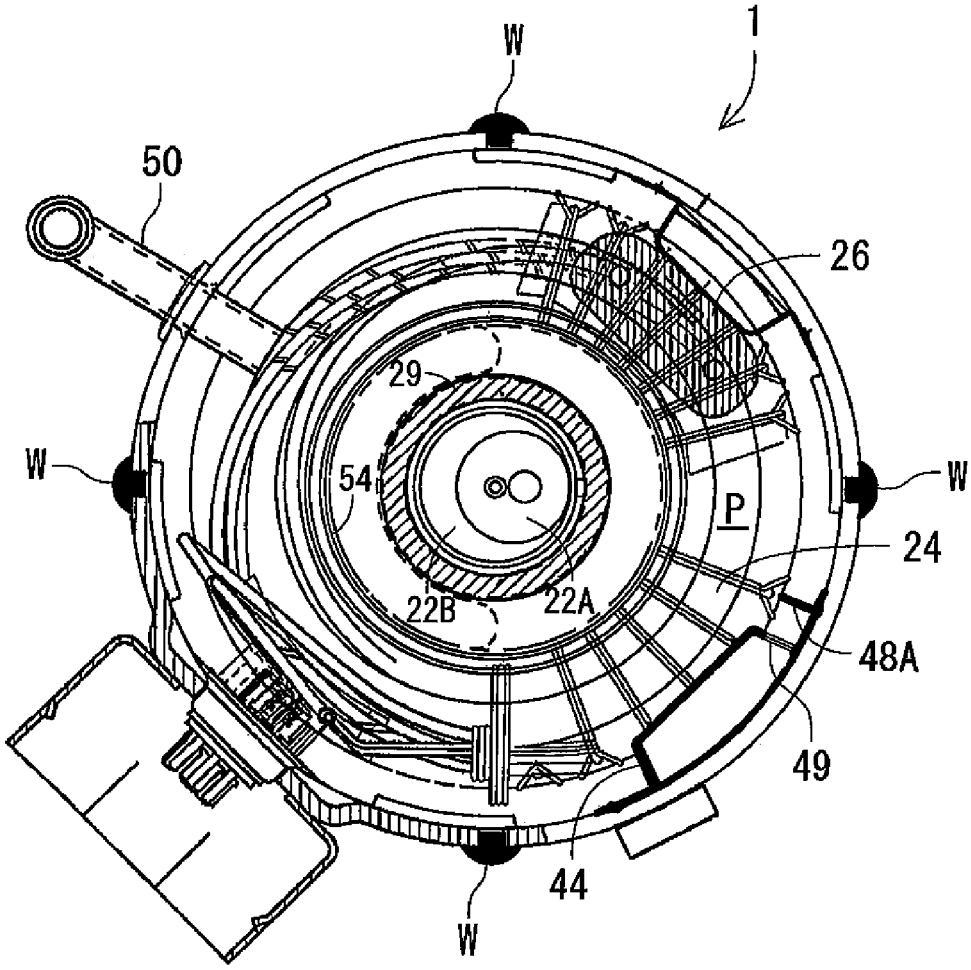
FIG. 2 is a laterally sectional view of the internal high pressure type scroll compressor of FIG. 1.
Figure 3:
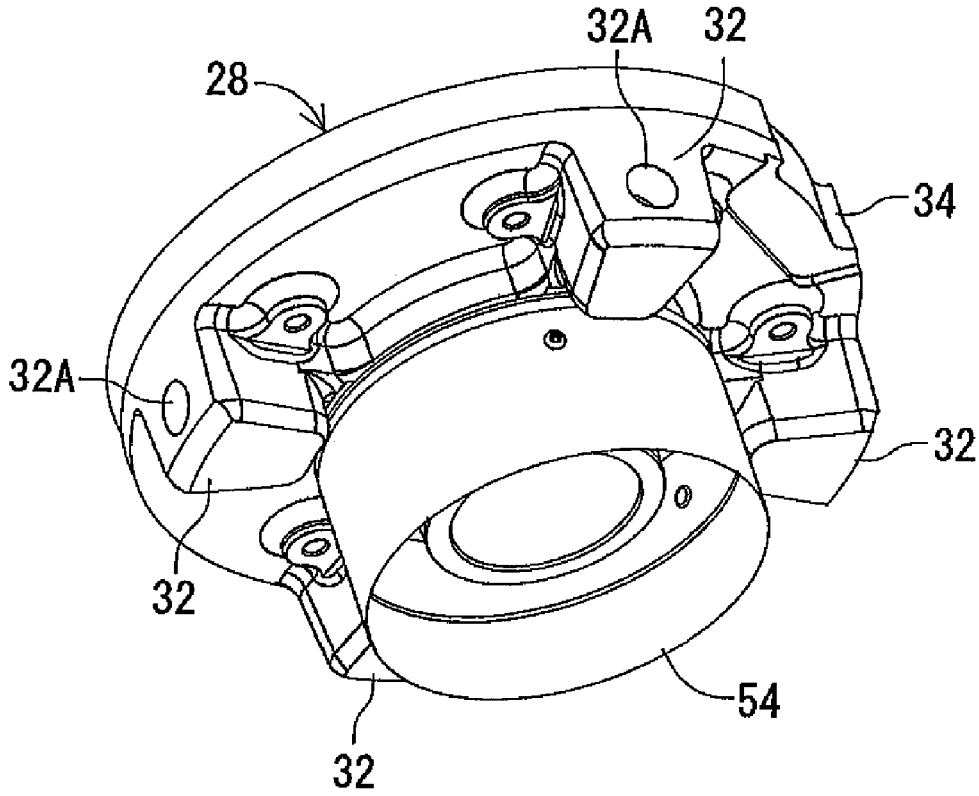
FIG. 3 is a perspective view of an upper support frame constituting the internal high pressure type scroll compressor of FIG. 1.

Next, an embodiment of the present invention will be described with reference to the drawings. FIG. 1 shows a vertical side view of an internal high pressure type scroll compressor 1 including a scroll compression element 10, showing the embodiment of the present invention, FIG. 2 shows a laterally sectional view of the internal high pressure type scroll compressor 1 including the scroll compression element 10 of FIG. 1, and FIG. 3 shows a perspective view of an upper support frame 28 constituting the internal high pressure type scroll compressor 1 including the scroll compression element 10, showing the embodiment of the present invention, respectively.

The scroll compressor 1 of the present embodiment is of an internal high pressure type, and includes, as shown in FIG. 1, a vertical type cylindrical sealed container 2 constituted of a steel plate, a motor element 20 received in an internal space of this sealed container 2, and the scroll compression element 10 positioned on the upside of this motor element 20 and driven by a shaft 22 of the motor element 20. The sealed container 2 is constituted of a container main body 4 having a bottom part as an oil reservoir 6 and receiving the motor element 20 (a motor) and the scroll compression element 10, a bowl-like end cap 4A attached so as to close an upper opening of this container main body 4 and a bowl-like bottom 4B attached so as to close a bottom opening of the container main body 4.

An upper support frame (a support frame) 28 is provided in the sealed container 2, and the sealed container 2 is partitioned into a discharge chamber 42 and a motor element side chamber 43 by this upper support frame 28. This discharge chamber 42 is formed on the side of the end cap 4A of the upper support frame 28 (the upside), and the motor element side chamber 43 is formed on the side of the bottom 4B of the upper support frame 28 (the downside). Specifically, the discharge chamber 42 is formed between the scroll compression element 10 and the end cap 4A.

In this case, the peripheral edge of the upper support frame 28 is provided with a plurality of (four in the embodiment) seat portions 32 which protrude on the motor element 20 side, and the seat portions 32 are fixed to the container main body 4 of the sealed container 2 by a weld W. Moreover, a discharge tube 50 constituted of a metal tube is welded and fixed to the container main body 4 (the sealed container 2) at a position corresponding to the vicinity of a bearing portion 30 of the upper support frame 28 described later, and this discharge tube 50 extends as much as a predetermined dimension in the container main body 4, and opens in the motor element side chamber 43 below the upper support frame 28.

Moreover, the scroll compression element 10 is constituted of a fixed scroll 12 fixed to the upper support frame 28, and a orbit scroll 14 which does not rotate itself but is revolved with respect to this fixed scroll 12 as described later. While the fixed scroll 12 is engaged with the orbit scroll 14, a compression space 16 (a compression chamber) is formed in a sealed space formed between the fixed scroll 12 and the orbit scroll 14. The fixed scroll 12 is constituted of a disc-like mirror plate 12A, and a lap 12B perpendicularly provided on this mirror plate and having an involute curve shape or a curved shape approximated to this involute curve shape, and the fixed scroll includes a discharge port 17 in the center of the fixed scroll, and a suction port 18 in the outer peripheral portion of the fixed scroll.

This suction port 18 is connected to a suction tube 51 passing through the end cap 4A of the sealed container 2 in a vertical direction, and this suction tube 51 is positioned on one side (e.g., the side of one of a plurality of support legs 70 described later) from the center line of the end cap 4A. Moreover, the discharge chamber 42 connected to the discharge port 17 communicates with the motor element side chamber 43 through a communication path 34 disposed between the scroll compression element 10 (the fixed scroll 12 and the orbit scroll 14) and the inner surface of the sealed container 2 (the inner surfaces of the end cap 4A and the container main body 4).

Moreover, the orbit scroll 14 includes a disc-like mirror plate 14A, a lap 14B perpendicularly provided on this mirror plate and formed into the same shape as that of the lap 12B of the fixed scroll 12, and a boss 29 protruding from the face of the mirror plate 14A opposite to the lap 14B and including a boss hole in the center of the boss. Furthermore, the center of the upper support frame 28 is provided with the bearing portion 30 continuously extending downwards, and the upper part of the shaft 22 is keeped by this bearing portion 30.

It is to be noted that the lower part of the shaft 22 is provided with an oil pump 76. This oil pump 76 pumps up the oil accumulated in the oil reservoir 6 disposed in the bottom part (the bottom 4B) of the sealed container 2 by the rotation of the shaft 22, to supply the oil to sliding portions (between the shaft 22 and the bearing portion 30, between an eccentric shaft 22A described later and the boss 29, between the orbit scroll 14 and the upper support frame 28, etc.) of the scroll compressor 1 through an oil passage 22C formed in the shaft 22.

The motor element 20 is constituted of a stator 23 including a coil and fixed (e.g., burn fit) to the inner surface of the container main body 4 of the sealed container 2, and a rotor 25 which rotates in the stator 23 and in which a magnet is incorporated, and the shaft 22 is fitted into the center of the rotor 25. Moreover, the lower part of the shaft 22 (the bottom 4B side of the rotor 25) is supported by a lower support frame 52 as a sub-bearing. This lower support frame 52 is fixed to the container main body 4 of the sealed container 2 below the motor element 20 by the weld W.

The tip of the upper portion of the shaft 22 constituting the motor element 20 is provided with the eccentric shaft (the pin) 22A whose shaft center deviates as much as a predetermined dimension from the shaft center of the shaft 22, and this eccentric shaft 22A is rotatably inserted into a boss hole of the boss 29 of the orbit scroll 14. Moreover, the fixed scroll 12 is fixed to the upper support frame 28 by a plurality of bolts 78 (only one bolt is shown in the drawing), and the orbit scroll 14 is supported on the upper support frame 28 by an Oldham's mechanism 40 constituted of an Oldham's ring 41 and an Oldham's key. In consequence, the orbit scroll 14 does not rotate itself but is revolved in the orbit with respect to the fixed scroll 12.

That is, in the orbit scroll 14, the boss 29 eccentrically inserted with respect to the shaft center of the shaft 22 is driven by the eccentric shaft 22A which is eccentric with respect to the shaft center of the shaft 22, and the orbit scroll does not rotate itself but is revolved along a circular orbit by the Oldham's ring 41 with respect to the fixed scroll 12. Moreover, by the rotation, the fixed scroll 12 and the orbit scroll 14 gradually reduce the plurality of crescent-like compression spaces 16 formed between the laps 12B and 14B, inwardly from the outside. In consequence, the refrigerant gas is sucked through the suction tube 51 into the compression spaces 16. Then, the sucked refrigerant gas is gradually compressed inwardly from the outside of the compression spaces 16 to form a high-pressure gas, and the gas is discharged from the discharge port 17 to the discharge chamber 42.

On the other hand, the stator 23 constituting the motor element 20 is fixed to the inner surface of the sealed container 2 (the container main body 4), and a predetermined gap 23A (a space) is formed between the peripheral edge of the stator 23 and the inner wall of the container main body 4. The gaps 23A are formed at four places around the stator 23 at an equal interval, and the periphery of the stator 23 other than the gaps 23A is fixed to the inner wall of the container main body 4. Moreover, the motor element side chamber 43 communicates with the oil reservoir 6 on the downside through the gaps 23A (passages) between the stator 23 and the inner surface of the sealed container 2. Moreover, the space upper portion of the motor element side chamber 43 communicates with the discharge tube 50 which extends through the sealed container 2 to open in the vicinity of the bearing portion 30.

Furthermore, the lower surface of the upper support frame 28 is provided with a shield plate 54 which extends from the upper support frame 28 to the motor element 20 side to surround the periphery of the bearing portion 30. This shield plate 54 is provided on the outer side of the bearing portion 30 with a predetermined space being left from the bearing portion. Specifically, the shield plate 54 corresponds to a region disposed on the inner side of a coil end 24 of the stator 23 and above the rotor 25, or an outer side from the region (see FIG. 1). It is to be noted that B is a balancer attached to the upper surface of the rotor 25, and the balancer is positioned on the inner side of the shield plate 54. Moreover, the sealed container 2 is provided with the plurality of (two are shown in FIG. 1) support legs 70 for vertically providing the sealed container 2.

The stator 23 constituting the motor element 20 is provided with an overcurrent protection apparatus 26 which stops the energization of the motor element 20 to protect a coil of the motor element at a time when an overcurrent flows through the motor element 20. This overcurrent protection apparatus 26 is arranged in a gas path P which extends from the communication path 34 formed on the outer side of the shield plate 54 to the discharge tube 50. Specifically, as shown in FIG. 2, the overcurrent protection apparatus 26 is provided at the coil end 24 of the stator 23 constituting the motor element 20, and is attached and fixed to the coil end 24 on the upper support frame 28 side.

Moreover, as shown in FIG. 3, the upper support frame 28 is provided with a plurality of (four in the embodiment) of seat portions 32 for fixing the upper support frame 28 to the container main body 4, the seat portions being positioned on the outer side of the shield plate 54. The seat portions 32 protrude as much as a predetermined dimension on the motor element 20 side, and are continuously integrally formed on the upper support frame 28. The seat portions 32 are formed at an equal interval in a circumferential direction, and are formed with a predetermined width in the circumferential direction. Moreover, the overcurrent protection apparatus 26 is fixed to the lower surface side (the stator 23 side) of the seat portions 32. It is to be noted that reference numerals 32A are weld holes for fixing the upper support frame 28 to the container main body 4 by the weld W.

On the other hand, a guide member 44 (a gas flow deflection member) is provided on the downside of the communication path 34. This guide member 44 changes, to a shield plate 54 direction, the flow direction of the refrigerant gas discharged from the discharge port 17 into the discharge chamber 42 and directed downwards through the communication path 34, and the guide member guides the refrigerant gas to a discharge tube 50 direction through the gas path P between the shield plate 54 above the coil end 24 of the motor element 20 and the inner surface of the container main body 4 (the sealed container 2).

Figure 4:
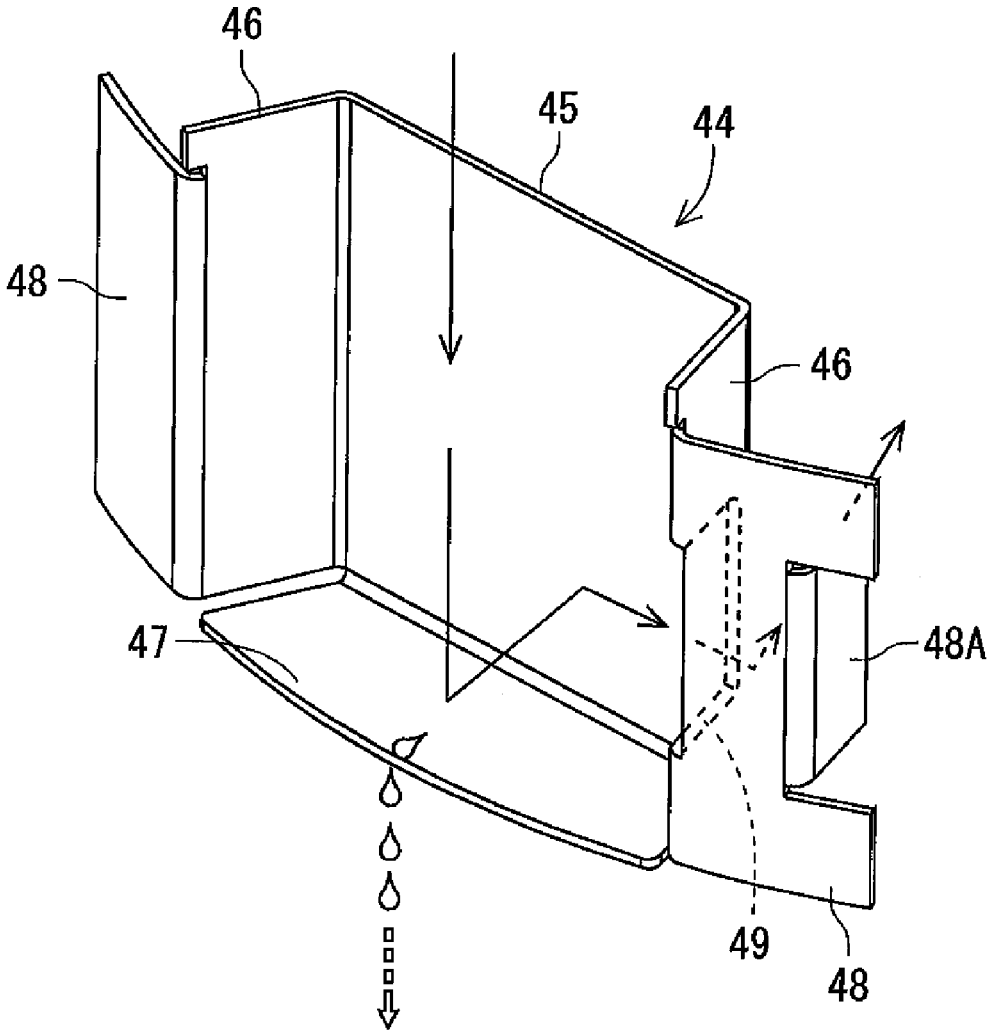
FIG. 4 is a perspective view of a guide member (a gas flow deflection member) provided in the internal high pressure type scroll compressor of FIG. 1.

Here, the guide member 44 is formed by cutting and bending one steel plate. As shown in FIG. 4, a substantially square outer wall 45 is formed in the center of the guide member 44, and both sides of this outer wall 45 are bent in the same direction as one side of the outer wall 45, thereby forming side walls 46, 46. The ends of both the side walls 46, 46 are further bent in a direction parallel to the outer wall 45 to form attachment walls 48, 48. That is, on both sides of the outer wall 45 are provided the attachment walls 48, 48 for attaching and fixing the guide member 44 to the inside of the container main body 4. Moreover, the lower side of the outer wall 45 is bent in the same direction as that of both the side walls 46, 46 to form a bottom wall 47.

Moreover, the attachment wall 48 on one side (the attachment wall 48 on the right side in the drawing) is provided with a bent guide wall 48A. This guide wall 48A extends as much as a predetermined dimension from the attachment wall 48 toward the outer wall 45 substantially in parallel with the side wall 46. That is, the guide wall 48A is formed by cutting an end (a side disposed away from the side wall 46) in a side wall 46 direction while a predetermined dimension is left at each end of the attachment wall 48 in a vertical direction, and bending a portion between both the cut portion in an outer wall 45 direction.

Both the attachment walls 48, 48 are welded and fixed to the inner surface of the container main body 4 (welded and fixed to the right side in the container main body 4 of FIG. 1), while the bottom wall 47 is the downside (a bottom 4B side) of the outer wall 45 as a reference, and the side opposite to the bottom wall 47 is the upside (an end cap 4A side). At this time, the guide member 44 is fixed to the inner surface of the container main body 4, while the upper ends of the outer wall 45 and both the side walls 46, 46 (on the side opposite to the bottom wall 47) abut on the upper support frame 28 or come close to the upper support frame with a gap being hardly left between the upper ends and the upper support frame.

In this case, the attachment walls 48, 48 are curved along the inner surface of the container main body 4 so that the attachment walls can come in close contact with and be fixed to the inside of the cylindrical container main body 4. Moreover, the bottom wall 47 on the side opposite to the outer wall 45 is curved along the inner surface of the container main body 4 so as to substantially face the inner surface of the container main body 4. It is to be noted that between the inner surface of the container main body 4 and the bottom wall 47 is provided such a gap that oil collected by the guide member 44 can drop down to the oil reservoir 6.

Moreover, as to a space formed by the outer wall 45, both the side walls 46, 46 and the inner surface of the container main body 4 while the guide member 44 is fixed to the inner surface of the container main body 4, the lower part of the space is substantially closed with the bottom wall 47, and the upper surface of the guide member is opened. In this state, the gas path P is formed between the guide member 44 and the container main body 4 to extend from the upper surface opening to a cutout 49 portion. The upper surface opening of the gas path P communicates with the communication path 34 disposed between the scroll compression element 10 and the inner surface of the sealed container 2, and the cutout 49 portion is positioned and opened in the gas path P extending from the cutout 49 portion of the guide member 44 to the discharge tube 50 on the outer side of the shield plate 54.

Furthermore, the discharge tube 50 of the scroll compressor 1 is connected to the inlet side of an external condenser (not shown), and the suction tube 51 is connected to the outlet side of an external evaporator (not shown). The scroll compressor 1, the condenser, a pressure reducing unit (not shown) and the evaporator constitute a well known refrigerant circuit. Moreover, the predetermined amount of the refrigerant gas is introduced in this refrigerant circuit. Then, the refrigerant gas discharged from the discharge port 17 of the scroll compression element 10 flows into the motor element side chamber 43 through the discharge chamber 42 and the communication path 34, flows out of the motor element side chamber 43, successively flows into the condenser, the pressure reducing unit and the evaporator from the discharge tube 50, and returns from the suction tube 51 to the suction port 18 of the scroll compression element 10. This circulation is repeated.

Next, the flow of the refrigerant gas and the oil of the scroll compressor 1 will schematically be described. When the stator 23 (the coil) of the motor element 20 is energized and the rotor 25 starts up to rotate the shaft 22, the orbit scroll 14 is revolved as described above. Specifically, when the shaft 22 starts up, the shaft 22 rotates in a counterclockwise direction in FIG. 2 to make a revolution of the orbit scroll 14. When the orbit scroll 14 is revolved, the refrigerant gas guided from the suction tube 51 to the suction port 18 is compressed in the compression spaces 16 of the scroll compression element 10, and then discharged from the discharge port 17 to the discharge chamber 42 to flow into the motor element side chamber 43 through the communication path 34.

Then, the refrigerant gas flows into the guide member 44, collides with the bottom wall 47 to become turbulent, and further collides with the periphery of the guide member 44 (the outer wall 45, the side walls 46, 46, the container main body 4, etc.). In consequence, the direction of the refrigerant gas changes to improve an oil separating function.

Then, as shown by arrows in FIG. 4, the flow direction of the refrigerant gas which has flowed into the guide member 44 and collided with the bottom wall 47 to become turbulent is changed, and the refrigerant gas flows out of the cutout 49, and collides with the guide wall 48A. The refrigerant gas which has collided with the guide wall 48A is discharged from the space between the guide wall 48A and the side wall 46 in the vertical direction and the center direction of the fixed scroll 12 (the shaft 22 direction). However, since the upper support frame 28 is disposed above the motor element side chamber 43 and the stator 23 is disposed below the motor element side chamber, most of the refrigerant gas flows toward the shaft 22 direction.

Moreover, since the shield plate 54 is provided on the inner side of the guide member 44 (in the shaft 22 direction), the refrigerant gas discharged from the space between the guide wall 48A and the side wall 46 in the shaft 22 direction further collides with the shield plate 54 to become turbulent. At this time, the refrigerant gas in the gas path P between the shield plate 54 and the inner surface of the container main body 4 moves from the guide member 44 side to the discharge tube 50 through the overcurrent protection apparatus 26 by the rotor 25 which rotates in the counterclockwise direction as described above.

The refrigerant gas which has collided with the guide wall 48A, changed its flow direction and collided with the shield plate 54 smoothly advances in the gas path P toward the overcurrent protection apparatus 26 by the rotation of the shaft 22, to collide with the overcurrent protection apparatus 26. When the refrigerant gas collides as much as a plurality of times in this manner, the oil separating function improves. Moreover, when the refrigerant gas collides as much as the plurality of times to improve an oil separation efficiency, most of the oil is separated from the refrigerant gas, and the refrigerant gas from which the oil has been separated then reaches the discharge tube 50 through the gas path P, and is discharged externally from the scroll compressor 1 (externally from the sealed container 2) through the discharge tube 50.

That is, the refrigerant gas in the gas path P collides with the overcurrent protection apparatus 26, thereby improving the oil separating function. In consequence, the mist-like oil included in the refrigerant gas is efficiently collected by the inner surface of the container main body 4, the coil end 24, the overcurrent protection apparatus 26 and the like.

Then, the oil separated from the refrigerant gas and collected by the guide member 44 drops down from the space 2 between the bottom wall 47 and the inner surface of the sealed container 2 (including the gap between the bottom wall 47 and the side wall 46) (dotted arrows in FIG. 4). Moreover, the oil collected by the overcurrent protection apparatus 26 also drops down, flows through the gap 23A. between the stator 23 and the inner surface of the sealed container 2 to drop down to the oil reservoir 6 on the downside, and is again supplied to the above-mentioned sliding portions by the oil pump 76.

Thus, since there is provided the shield plate 54 extending from the upper support frame 28 to the motor element 20 side to surround the periphery of the bearing portion 30, this shield plate 54 can effectively suppress a disadvantage that the oil which has flowed out of the bearing portion 30 is discharged through the discharge tube 50.

Moreover, the shield plate 54 can prevent the refrigerant gas guided from the communication path 34 to the motor element 20 side from being rotated by the rotation of the motor element 20. In consequence, it is possible to suppress a disadvantage that by a centrifugal force generated by the rotation of the rotor 25, the oil separated from the refrigerant gas to remain at the inner surface of the sealed container 2 moves in the discharge tube 50 direction, and is discharged through the discharge tube 50.

In particular, since the guide member 44 (the gas flow deflection member) is provided at the outlet of the communication path 34 to guide the discharged gas in the shield plate 54 direction, the gas guided from the communication path 34 to the motor element 20 side is blown to the shield plate 54 by the guide member 44. In consequence, the separation of the oil in the gas is promoted, and in general, the amount of the oil to be discharged through the discharge tube 50 can effectively be decreased.

Moreover, the overcurrent protection apparatus 26 for the motor element 20 is attached to the coil end 24 of the stator 23 constituting the motor element 20, and this overcurrent protection apparatus 26 is arranged in the gas path P extending from the communication path 34 on the outer side of the shield plate 54 to the discharge tube 50. In consequence, the gas guided to the motor element 20 side through the communication path 34 and directed to the discharge tube 50 through the gas path P on the outer side of the shield plate 54 collides with the overcurrent protection apparatus 26 provided in the gas path. Moreover, when the gas collides with the overcurrent protection apparatus 26, the oil in the gas is further effectively separated, and consequently the amount of the oil to be discharged through the discharge tube 50 can further be suppressed.

(Embodiment 2)

Figure 5:
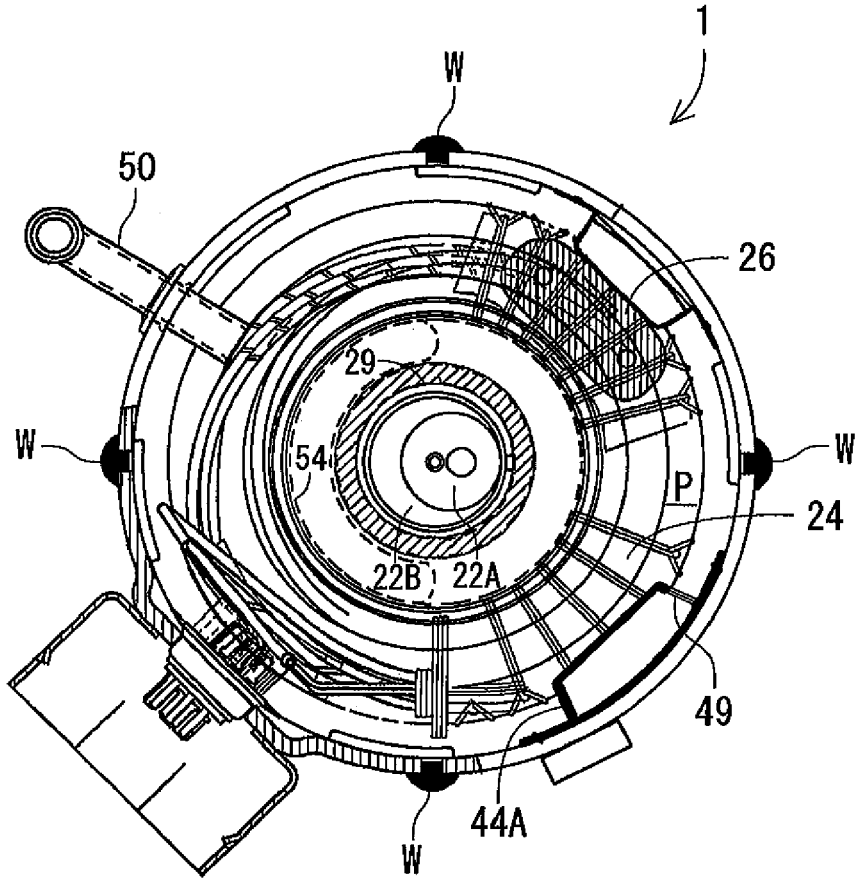
FIG. 5 is a laterally sectional view of an internal high pressure type scroll compressor including a scroll compression element, showing Embodiment 2 of the present invention.
Figure 6:
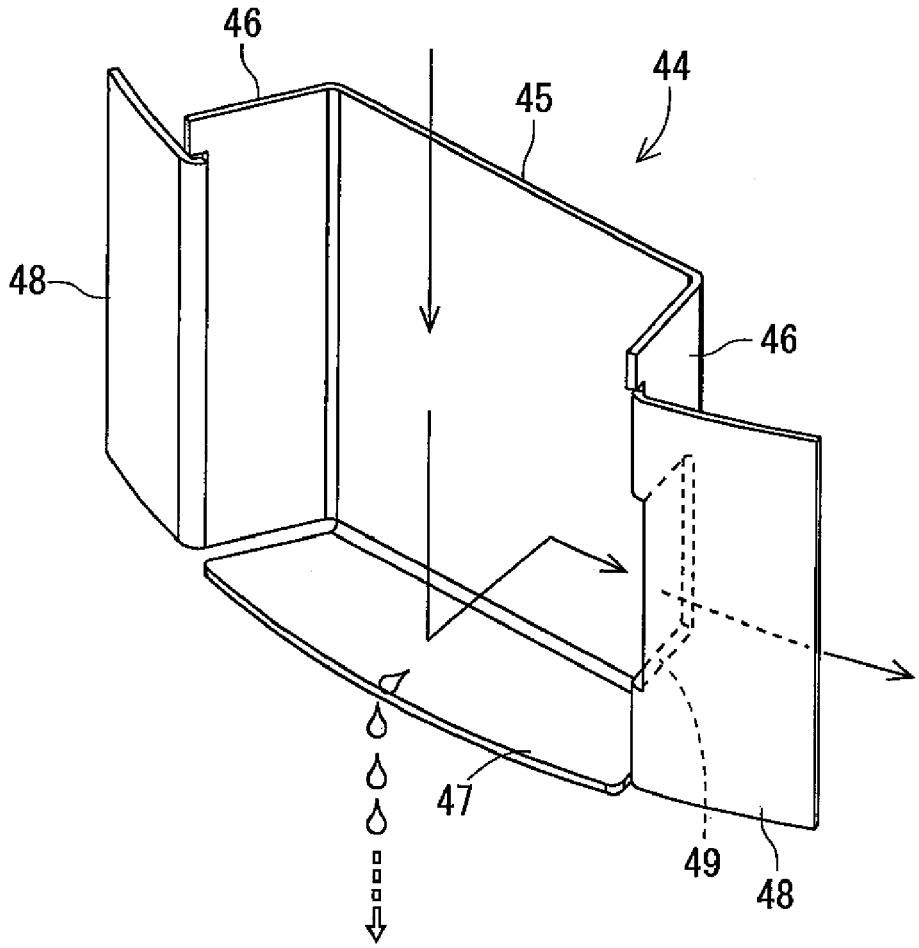
FIG. 6 is a perspective view of a guide member (a gas flow deflection member) provided in the internal high pressure type scroll compressor of FIG. 5.

Next, another embodiment of the present invention will be described in detail with reference to FIGS. 5 and 6. FIG. 5 shows a laterally sectional view of a scroll compressor 1 in this embodiment, and FIG. 6 shows a perspective view of a guide member 44 provided in the scroll compressor 1 of FIG. 5, respectively.

In Embodiment 1 described above, in the attachment wall 48 of the guide member 44 on one side is provided the guide wall 48A bent from the attachment wall 48 in the outer wall 45 direction substantially in parallel with the side wall 46, but any guide wall 48A is not formed in the guide member 44 of this embodiment. That is, the scroll compressor 1 of the present embodiment is different from Embodiment 1 described above only in the presence of the guide wall 48A of the guide member 44, and another structure of the scroll compressor 1, a structure of the guide member 44 other than the guide wall 48A, a fixing method and the like are similar to those described above in detail in Embodiment 1.

That is, evening this case, the guide member 44 (the gas flow deflection member) is also provided on the downside of a communication path 34. This guide member 44 changes the flow direction of a refrigerant gas discharged from a discharge port 17 into a discharge chamber 42 and directed downwards through the communication path 34 to a horizontal direction along the inner surface of the container main body 4 (a sealed container 2), and the guide member guides the refrigerant gas to a discharge tube 50 direction through a gas path P between a shield plate 54 above a coil end 24 of a motor element 20 and the inner surface of the container main body 4 (the sealed container 2).

Here, even in this case, the guide member 44 is formed by cutting and bending one steel plate. As shown in FIG. 6, a substantially square outer wall 45 is formed in the center of the guide member 44, and both sides of this outer wall 45 are bent in the same direction to one side of the outer wall 45, thereby forming side walls 46, 46. The ends of both the side walls 46, 46 are further bent in a direction parallel to the outer wall 45 to form attachment walls 48, 48. That is, on both sides of the outer wall 45 are provided the attachment walls 48, 48 for attaching and fixing the guide member 44 to the inside of the container main body 4. Moreover, the lower side of the outer wall 45 is provided with a bottom wall 47 bent in the same direction as that of both the side walls 46, 46.

Both the attachment walls 48, 48 are welded and fixed to the inner surface of the container main body 4 (welded and fixed to the right side in the container main body 4 of FIG. 1), while the bottom wall 47 is the downside (a bottom 4B side) of the outer wall 45 as a reference, and the side opposite to the bottom wall 47 is the upside (an end cap 4A side) At this time, the guide member 44 is fixed to the inner surface of the container main body 4, while the upper ends of the outer wall 45 and both the side walls 46, 46 (on the side opposite to the bottom wall 47) abut on an upper support frame 28 or come close to the upper support frame with a gap being hardly left between the upper ends and the upper support frame.

In this case, the attachment walls 48, 48 are curved along the inner surface of the container main body 4 so that the attachment walls can come in close contact with and be fixed to the inside of the cylindrical container main body 4. Moreover, the bottom wall 47 on the side opposite to the outer wall 45 is curved along the inner surface of the container main body 4 so as to substantially face the inner surface of the container main body 4. It is to be noted that between the inner surface of the container main body 4 and the bottom wall 47 is provided such a gap that oil collected by the guide member 44 can drop down to an oil reservoir 6.

Moreover, as to a space formed by the outer wall 45, both the side walls 46, 46 and the inner surface of the container main body 4 while the guide member 44 is fixed to the inner surface of the container main body 4, the lower part of the space is substantially closed with the bottom wall 47, and the upper surface of the guide member is opened. In this state, the gas path P is formed between the guide member 44 and the container main body 4 to extend from the upper surface opening to a cutout 49 portion. The upper surface opening of the gas path P communicates with the communication path 34 disposed between a scroll compression element 10 and the inner surface of the sealed container 2, and the cutout 49 portion is positioned and opened in the gas path P extending from the cutout 49 portion of the guide member 44 to the discharge tube 50 on the outer side of the shield plate 54.

Next, the flow of the refrigerant gas and the oil of the scroll compressor 1 of this embodiment will schematically be described. When a stator 23 (a coil) of the motor element 20 is energized and a rotor 25 starts up to rotate a shaft 22, a orbit scroll 14 is revolved as described above. Specifically, when the shaft 22 starts up, the shaft 22 rotates in a counterclockwise direction in FIG. 5 to make the revolution of the orbit scroll 14. When the orbit scroll 14 is revolved, the refrigerant gas guided from a suction tube 51 to a suction port 18 is compressed in compression spaces 16 of the scroll compression element 10, and then discharged from the discharge port 17 to the discharge chamber 42 to flow into a motor element side chamber 43 through the communication path 34.

Then, the refrigerant gas flows into the guide member 44, collides with the bottom wall 47 to become turbulent, and further collides with the periphery of the guide member 44 (the outer wall 45, the side walls 46, 46, the container main body 4, etc.). In consequence, the direction of the refrigerant gas changes to improve an oil separating function.

Then, as shown by arrows in FIG. 6, the flow direction of the refrigerant gas which has flowed into the guide member 44 and collided with the bottom wall 47 to become turbulent is changed, and the refrigerant gas is discharged in an overcurrent protection apparatus 26 direction in the gas path P between the shield plate 54 and the inner surface of the container main body 4. At this time, the refrigerant gas in the gas path P moves in the discharge tube 50 direction from the guide member 44 side through the overcurrent protection apparatus 26 by the rotor 25 which rotates in the counterclockwise direction as described above.

In this case, the refrigerant gas discharged from the cutout 49 smoothly advances in the overcurrent protection apparatus 26 direction in the gas path P by the rotation of the shaft 22, and collides with the overcurrent protection apparatus 26. In consequence, the direction of the refrigerant gas changes to improve the oil separating function. That is, when the refrigerant gas collides with the inside of the guide member 44 and the overcurrent protection apparatus 26 as much as a plurality of times, an oil separation efficiency improves, and most of the oil included in the refrigerant gas is separated.

Then, the refrigerant gas from which the oil has been separated further advances in the counterclockwise direction in the gas path P, and is discharged externally from the scroll compressor 1 (externally from the sealed container 2) through the discharge tube 50. Such mist-like oil included in the refrigerant gas is efficiently collected by the inner surface of the container main body 4, the coil end 24, the overcurrent protection apparatus 26 and the like.

Then, the oil separated from the refrigerant gas and collected by the guide member 44 drops down from the gap 2 between the bottom wall 47 and the inner surface of the sealed container 2 (including the gap between the bottom wall 47 and the side wall 46) (a dotted arrow in FIG. 6). Moreover, the oil collected by the overcurrent protection apparatus 26 also drops down, flows through a gap 23A between the stator 23 and the inner surface of the sealed container 2 to drop down to the oil reservoir 6 on the downside, and is again supplied to the above-mentioned sliding portions by an oil pump 76.

Thus, the scroll compressor includes the overcurrent protection apparatus 26 for the motor element 20 attached to the coil end 24 of the stator 23 constituting the motor element 20, and the guide member 44 (the gas flow deflection member) provided at an outlet of the communication path 34 to guide the discharged gas in the direction of the overcurrent protection apparatus 26. In consequence, the refrigerant gas guided from the communication path 34 to the motor element 20 side and directed to the discharge tube 50 is guided in the direction of the overcurrent protection apparatus 26 by the guide member 44, and collides with the overcurrent protection apparatus 26. When the gas collides with the overcurrent protection apparatus 26, the oil in the refrigerant gas can effectively be separated, and hence the amount of the oil to be discharged through the discharge tube 50 can remarkably effectively be suppressed.

Moreover, the scroll compressor includes the shield plate 54 extending from the support frame 28 to the motor element 20 side to surround the periphery of a bearing portion 30, and the overcurrent protection apparatus 26 is positioned in the gas path P extending from the communication path 34 on the outer side of the shield plate 54 to the discharge tube 50. In consequence, the refrigerant gas guided to the motor element 20 side through the communication path 34 passes through the gas path P disposed on the outer side of the shield plate 54, and the gas can smoothly collide with the overcurrent protection apparatus 26.

In particular, the shield plate 54 can effectively suppress a disadvantage that the oil which has flowed out of the bearing portion 30 is discharged through the discharge tube 50. Moreover, the shield plate 54 can prevent the refrigerant gas guided from the communication path 34 to the motor element 20 side from being rotated by the rotation of the motor element 20 (the rotor 25). In consequence, it is possible to suppress a disadvantage that by a centrifugal force generated by the rotation of the refrigerant gas, the oil separated from the refrigerant gas to remain at the inner surface of the sealed container 2 moves in the discharge tube 50 direction, and is discharged through the discharge tube 50.

(Embodiment 3)

Next, still another embodiment of the present invention will be described in detail. In this embodiment, in addition to the above constitution of Embodiment 1, a plurality of seat portions for fixing an upper support frame to a container main body are provided with oil separation members, thereby improving an oil separation efficiency to decrease the amount of oil to be discharged through a discharge tube. Hereinafter, this embodiment will be described in detail with reference to FIGS. 7 to 21.

Figure 7:
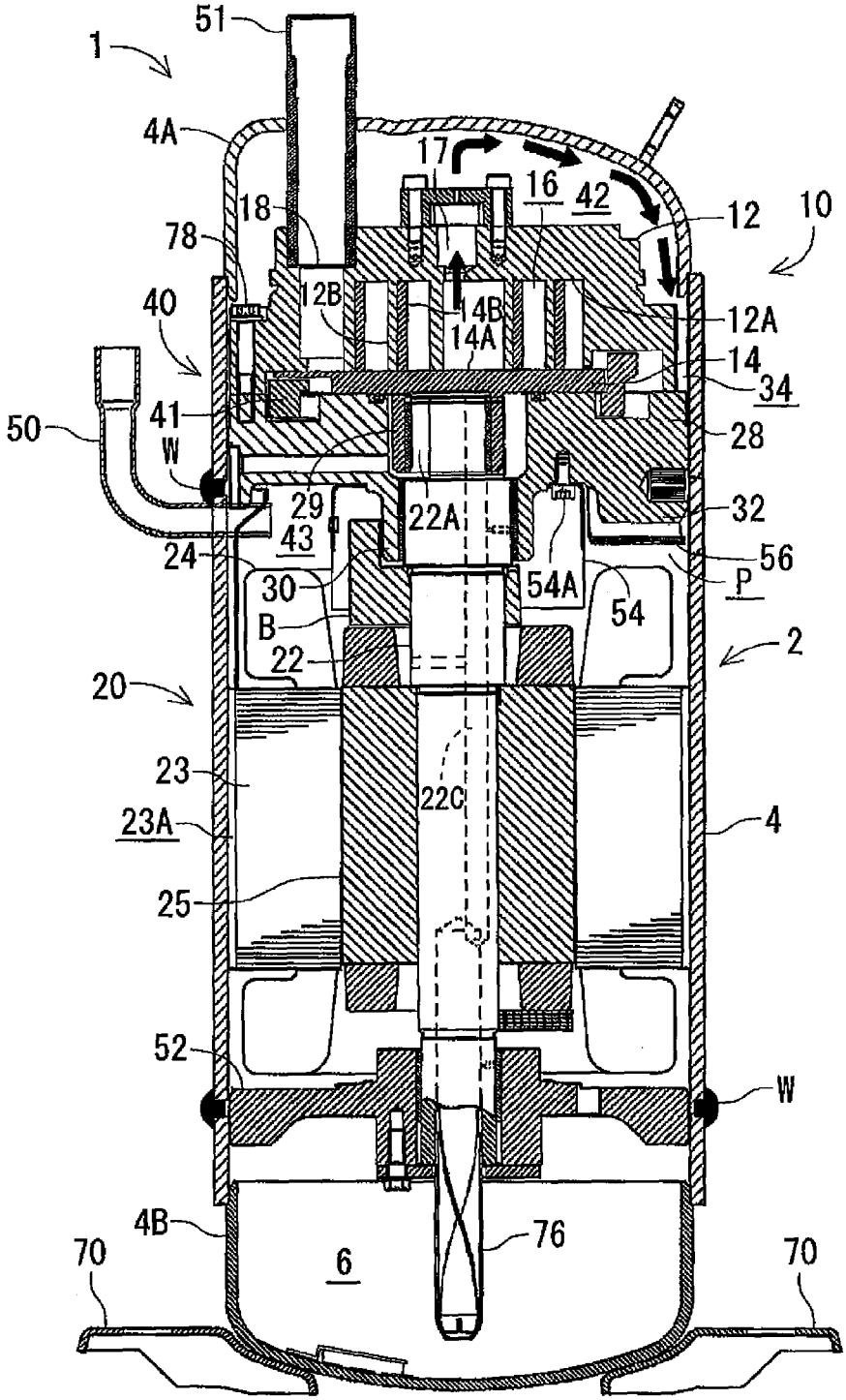
FIG. 7 is a vertical side view of an internal high pressure type scroll compressor including a scroll compression element, showing Embodiment 3 of the present invention (corresponding to a section cut along the A-A line of FIG. 13)
Figure 8:
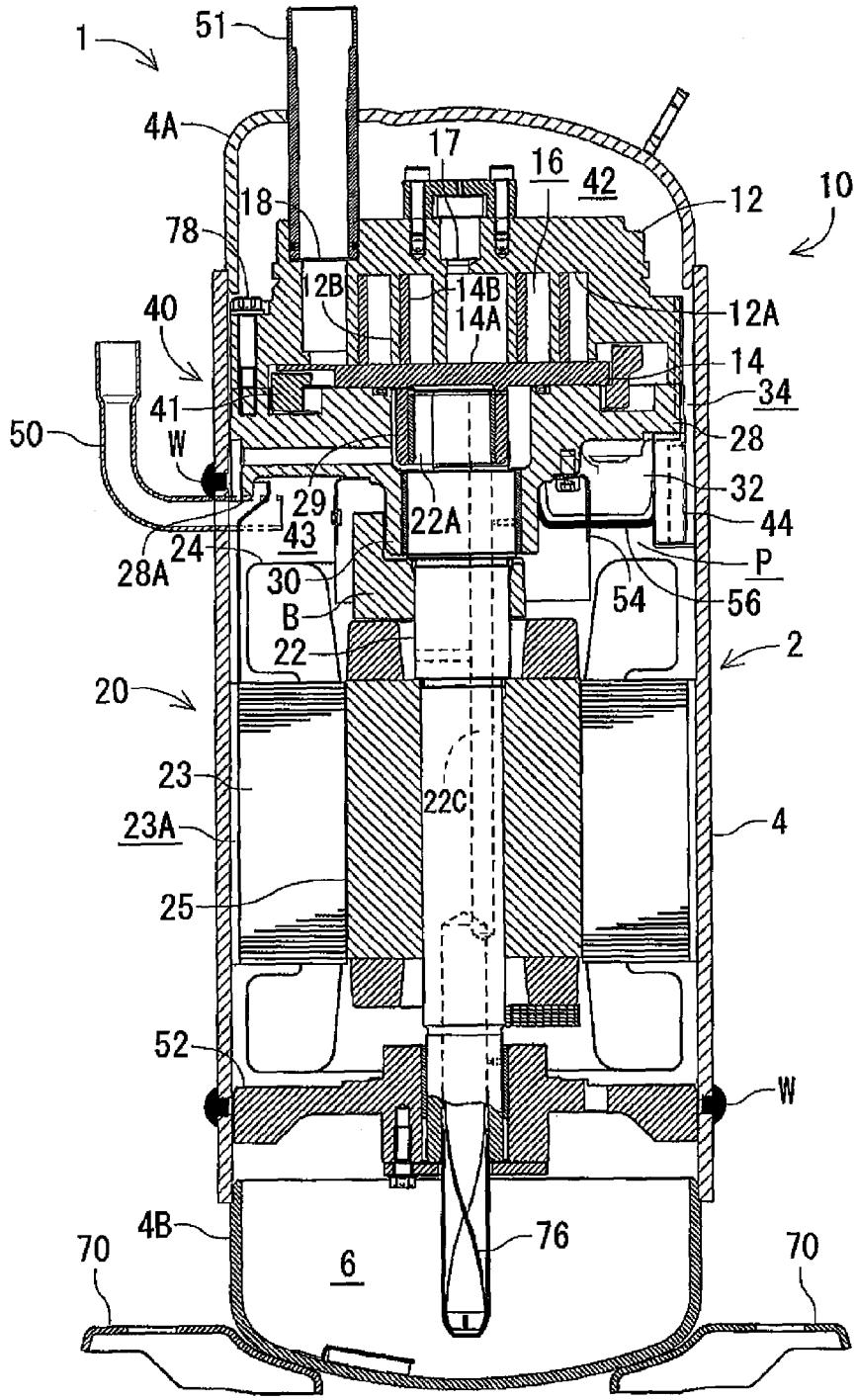
FIG. 8 is another vertical side view of the internal high pressure type scroll compressor of FIG. 7 (corresponding to a section cut along the B-B line of FIG. 13)
Figure 9:
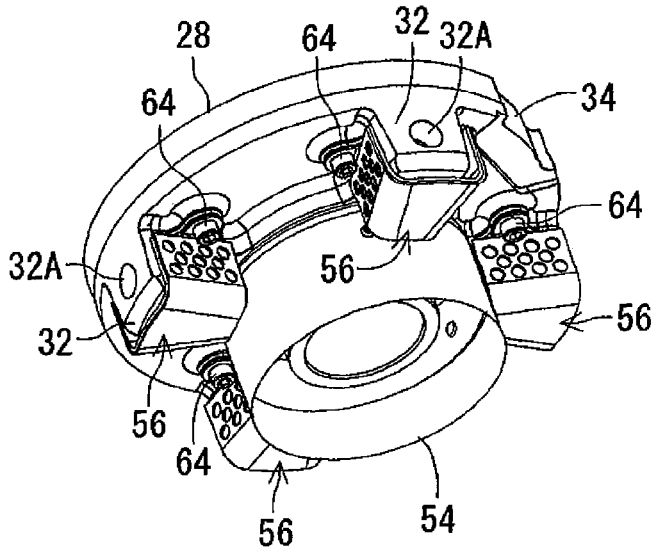
FIG. 9 is a perspective view of an upper support frame constituting the internal high pressure type scroll compressor of FIG. 7.
Figure 13:
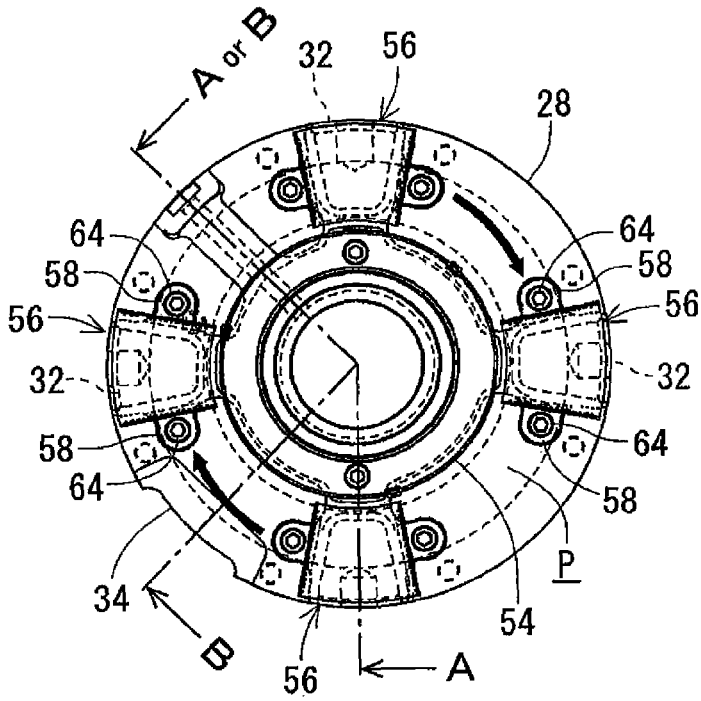
FIG. 13 is a bottom view of the upper support frame constituting the internal high pressure type scroll compressor of FIG. 7.

FIGS. 7 and 8 show vertical side views of an internal high pressure type scroll compressor 1 in this embodiment, and FIG. 9 shows a perspective view of an upper support frame 28 constituting the internal high pressure type scroll compressor 1, respectively. FIGS. 7 and 8 show different sections. Specifically, FIG. 7 is a sectional view from an arrow direction, corresponding to a case where the scroll compressor 1 is cut along the A-A line of FIG. 13, and FIG. 8 is a sectional view from an arrow direction, corresponding to a case where the scroll compressor is cut along the B-B line of FIG. 13. It is to be noted that the scroll compressor 1 in the embodiment of FIGS. 7, 8 is also of an internal high pressure type in the same manner as in the above embodiments. Hereinafter, in FIGS. 7 to 21, components denoted with the same reference numerals as those of FIGS. 1 to 6 produce the same or similar effects or functions, and hence the description thereof is omitted.

In FIG. 7, reference numeral 54A is a bolt for fixing a shield plate 54 to the upper support frame 28. The shield plate 54 extends from the upper support frame 28 to a motor element 20 side to surround the periphery of a bearing portion 30 as described in detail in the above embodiments. An upper portion of this shield plate 54 bent on a shaft 22 side is fixed to the lower surface of the upper support frame 28 by the bolt 54A (shown in FIG. 7).

Moreover, as shown in FIG. 8, even in the scroll compressor 1 of the present embodiment, a guide member 44 (the gas flow deflection member) is provided on the downside of a communication path 34. As described above in detail in Embodiment 1, this guide member 44 changes, to a shield plate 54 direction, the flow direction of a refrigerant gas discharged from a discharge port 17 to a discharge chamber 42 and directed downwards through the communication path 34, and the guide member guides the refrigerant gas to a discharge tube 50 direction through a gas path P between the shield plate 54 above a coil end 24 of a motor element 20 and the inner surface of a container main body 4 (a sealed container 2). It is to be noted that a structure of the guide member 44, a fixing method and the like are similar to those described above in detail in Embodiment 1, and hence the description thereof is omitted.

On the other hand, the upper support frame 28 of the present embodiment is provided with a plurality of (four in the embodiment) seat portions 32 which are positioned on the outer side of the shield plate 54 and which fix the upper support frame 28 to the container main body 4 as shown in FIGS. 9, 10, 11 and 12. The seat portions 32 are formed to protrude as much as a predetermined dimension to the motor element 20 side, and are continuously integrally formed in the upper support frame 28. Moreover, these seat portions 32 are provided with oil separation members 56 attached so as to cover the seat portions 32, respectively, and the oil separation members 56 are covered with an air-permeable insulating material 60. It is to be noted that the oil separation members 56 and the insulating material 60 are described later in detail. Moreover, in FIGS. 9, 10, 11 and 12, reference numerals 56 are the oil separation members covered with the insulating material 60.

As shown by dotted lines in FIG. 13, the four seat portions 32 are formed at an equal interval in a circumferential direction, and are formed with a predetermined width in the circumferential direction. When each seat portion 32 is viewed from the motor element 20 side, the seat portion 32 is formed into a circular shape (as a part of the circular shape) around the shaft 22 by use of one side (the center side) and the other side (the outer peripheral side) of the upper support frame 28, and is formed into a fan-like shape narrowed on the one side and broadened on the other side. It is to be noted that reference numerals 32A are weld holes for fixing the upper support frame 28 to the container main body 4 by a weld W.

Figure 14:
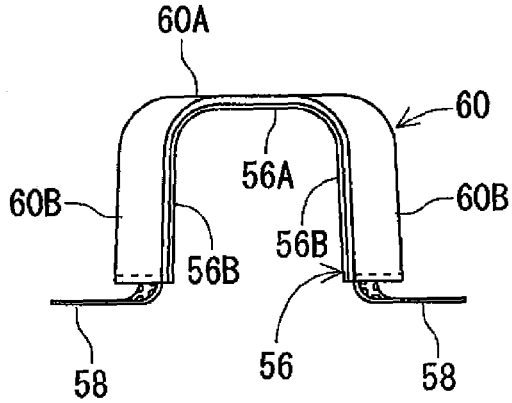
FIG. 14 is a front view of an oil separation member provided in the internal high pressure type scroll compressor of FIG. 7.
Figure 15:
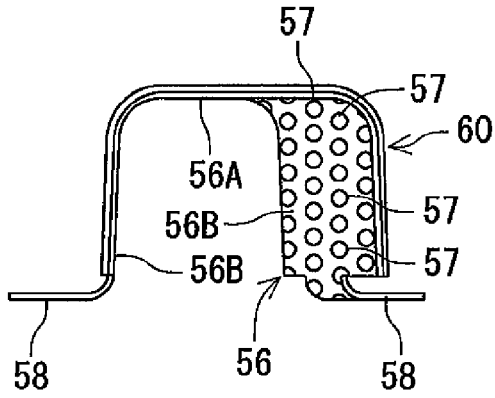
FIG. 15 is a back view of the oil separation member of FIG. 14.

As shown in FIGS. 14, 15, each oil separation member 56 includes a main plate portion 56A positioned at a flat face substantially parallel to the lower surface of each seat portion 32, side plate portions 56B bent substantially at right angles and positioned on both sides of the main plate portion 56A, and fixed plate portions 58 provided at ends (the lower ends in FIGS. 14, 15) of both the side plate portions 56B, 56B and bent as much as a predetermined dimension to extend in directions away from each other. The oil separation member 56 is constituted of a steel plate having a plate thickness of about 0.6 mm, and the one steel plate is bent to integrally form the main plate portion 56A, the side plate portions 56B and the fixed plate portions 58.

The oil separation member 56 is provided with a plurality of through holes 57 (shown in FIG. 15) extending through the steel plate (the oil separation member 56) in a plate thickness direction, and these through holes 57 are arranged at a predetermined interval. That is, each through hole 57 is formed into a circular shape having a diameter of about 2.0 mm, and the plurality of through holes 57 are arranged at an interval of about 3.5 mm in a staggered state. These through holes 57 are formed in all of the main plate portion 56A, the side plate portions 56B, 56B and the fixed plate portions 58 (shown in FIGS. 15, 16). It is to be noted that the shape of each through hole 57 is not limited to the circular shape, and may be formed into a square shape, an elliptic shape, a star-like shape, a triangular shape or the like.

Figure 16:
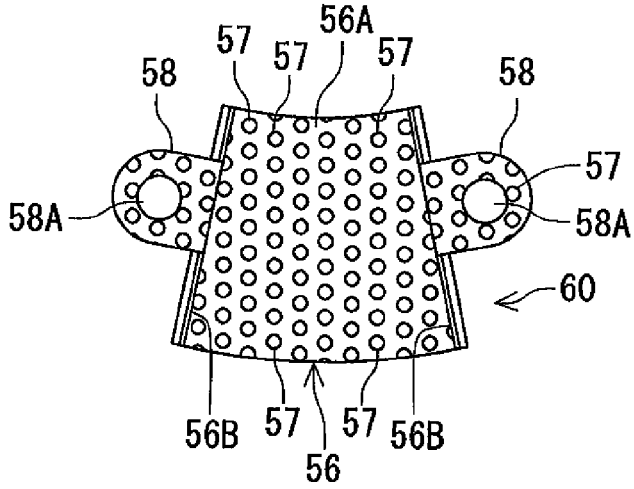
FIG. 16 is a bottom view of the oil separation member of FIG. 14.
Figure 17:
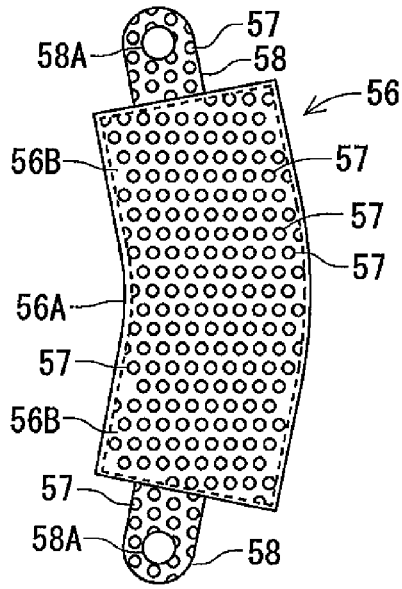
FIG. 17 is a plan view at a time when the oil separation member of FIG. 14 is punched with a press.

Each fixed plate portion 58 is formed with a dimension smaller than that of the side plate portion 56B (the dimension in a radial direction around the shaft 22), and is also formed with a predetermined width. The fixed plate portion on a side away from the side plate portion 56B is formed into a semicircular shape (FIG. 16). Moreover, the fixed plate portion 58 is provided with a fixing hole 58A having a diameter of about 6.0 mm, and this fixing hole 58A is provided to extend through the steel plate in the plate thickness direction. Moreover, the oil separation member 56 is fixed to the upper support frame 28 together with the insulating material 60 described later while the bolts 64 are inserted into the fixing holes 58A. It is to be noted that a method for fixing the oil separation members 56 to the upper support frame 28 will be described later.

Figure 10:
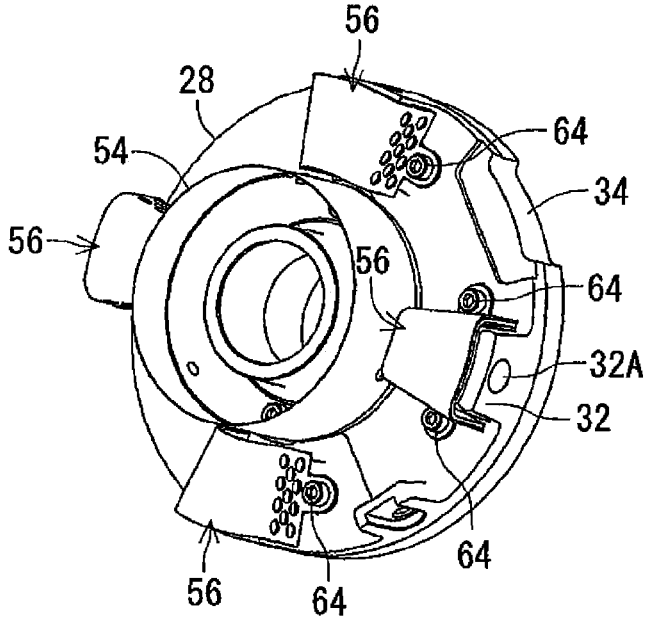
FIG. 10 is another perspective view of the upper support frame constituting the internal high pressure type scroll compressor of FIG. 7.
Figure 11:
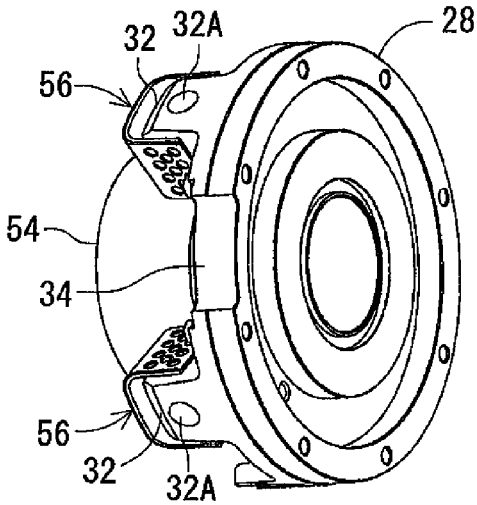
FIG. 11 is still another perspective view of the upper support frame constituting the internal high pressure type scroll compressor of FIG. 7.
Figure 12:
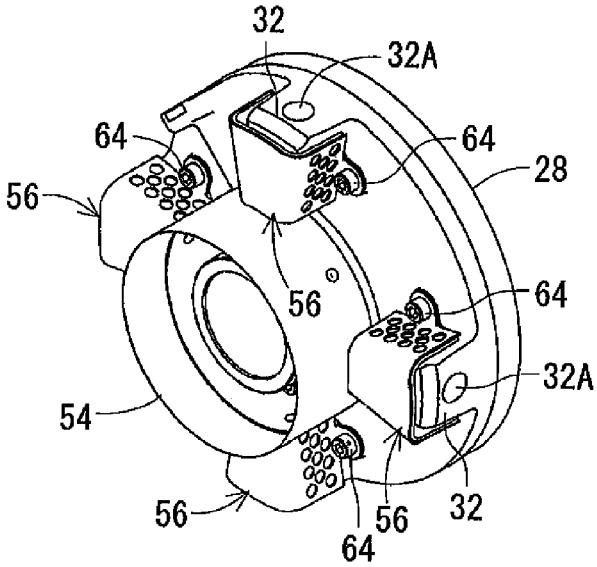
FIG. 12 is a further perspective view of the upper support frame constituting the internal high pressure type scroll compressor of FIG. 7.

Here, a preparation method of the oil separation members 56 will be described. To prepare the oil separation member 56, the plurality of through holes 57 are made in the steel plate with a press, and then the steel plate is cut into a flat face shape before a state in which the main plate portion 56A, the side plate portions 56B on both sides and the fixed plate portions 58 are bent as shown in FIG. 10. Moreover, the plurality of through holes 57 are made. Furthermore, the fixed plate portions 58 and the side plate portions 56B are bent from the main plate portion 56A in the center, thereby completing the oil separation member 56.

Figure 18:
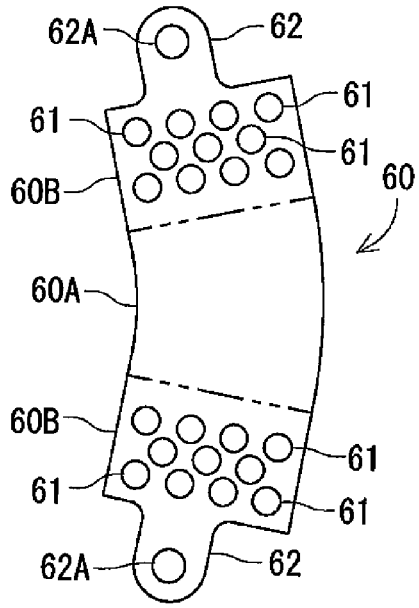
FIG. 18 is a plan view at a time when an insulating material for covering the oil separation member of FIG. 14 is punched with the press.

On the other hand, the insulating material 60 is constituted of, for example, a highly insulating member (e.g., Lumirror (trade name)). This insulating material 60 is attached to the upper support frame 28 to cover the oil separation member 56, and is formed into an outer shape similar to or slightly larger than that of the oil separation member 56. As shown in FIG. 18, this insulating material 60 is constituted of a flat plate portion 60A having a shape slightly larger (about 1 to 2 mm larger) than that of the main plate portion 56A of the oil separation member 56, lateral plate portions 60B bent substantially at right angles, positioned on both sides of the flat plate portion 60A and formed into a shape slightly larger (about 1 to 2 mm larger) than that of each side plate portion 56B, and fixed piece portions 62 provided at ends of both the lateral plate portions 60B, 60B, bent as much as a predetermined dimension to extend in directions away from each other and having substantially the same shape as that of each fixed plate portion 58. That is, the insulating material 60 is formed into the shape larger than that of the oil separation member 56, whereby an insulating effect between the oil separation members 56 and the motor element 20, especially between the oil separation members and the coil end 24 is improved. It is to be noted that FIGS. 14, 15 and 19 do not show any fixed piece portion 62.

The insulating material 60 is provided with through holes 61 extending through the insulating material 60 in the plate thickness direction and having a diameter larger than that of each through hole 57 provided in the oil separation member 56, and these through holes 61 are arranged at a predetermined interval. That is, each through hole 61 is formed into a circular shape having a diameter of 5.0 mm, and the plurality of through holes 61 are arranged at an interval of about 8.0 mm in a staggered state. These through holes 61 are formed only in both the lateral plate portions 60B, 60B (excluding the flat plate portion 60A and the fixed piece portions 62). In consequence, when the plurality of through holes 61 are provided in, for example, the flat plate portion 60A, the through holes are provided so that oil collected by the oil separation members 56 does not drop down onto the coil end 24. It is to be noted that the shape of each through hole 61 is not limited to the circular shape, and may be formed into a square shape, an elliptic shape, a star-like shape, a triangular shape or the like.

Moreover, the fixed piece portions 62 are provided with fixing holes 62A substantially similar to the fixing holes 58A, and the fixing holes 62A are provided to extend through the insulating material 60 in the plate thickness direction. Furthermore, the insulating material 60 is superimposed to cover the oil separation member 56 from the side away from the upper support frame 28, and in this state, the bolts 64 are inserted into the fixing holes 58A to fix the insulating material to the upper support frame 28.

Figure 19:
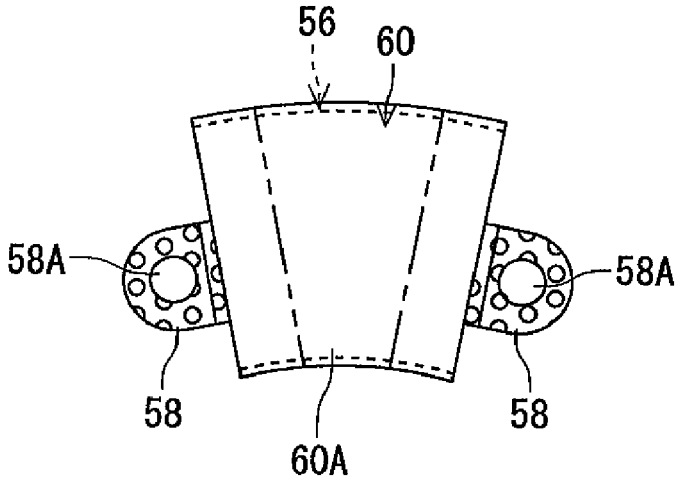
FIG. 19 is a plan view of the oil separation member of FIG. 14.

Next, a method for fixing the oil separation members 56 and the insulating material 60 to the upper support frame 28 will be described. First, as shown in FIG. 19, the insulating material 60 is superimposed onto the oil separation member 56 to superimpose the fixing holes 58A of the oil separation member 56 onto the fixing holes 62A of the insulating material 60. In this state, the main plate portion 56A of the oil separation member 56 and the flat plate portion 60A of the insulating material 60, both the side plate portions 56B of the oil separation member 56 and both the lateral plate portions 60B of the insulating material 60, and both the fixed plate portions 58 of the oil separation member 56 and the fixed piece portions 62 of the insulating material 60 substantially come in close contact with each other and abut on each other.

Figure 20:
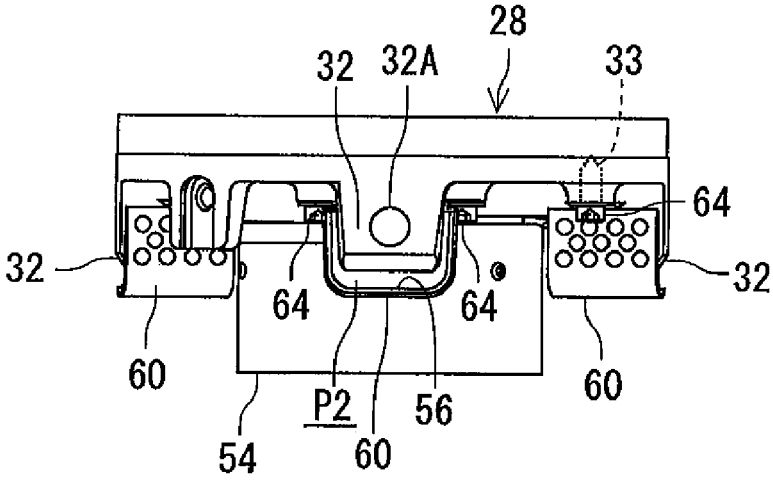
FIG. 20 is a front view of the upper support frame constituting the internal high pressure type scroll compressor of FIG. 7.
Figure 21:
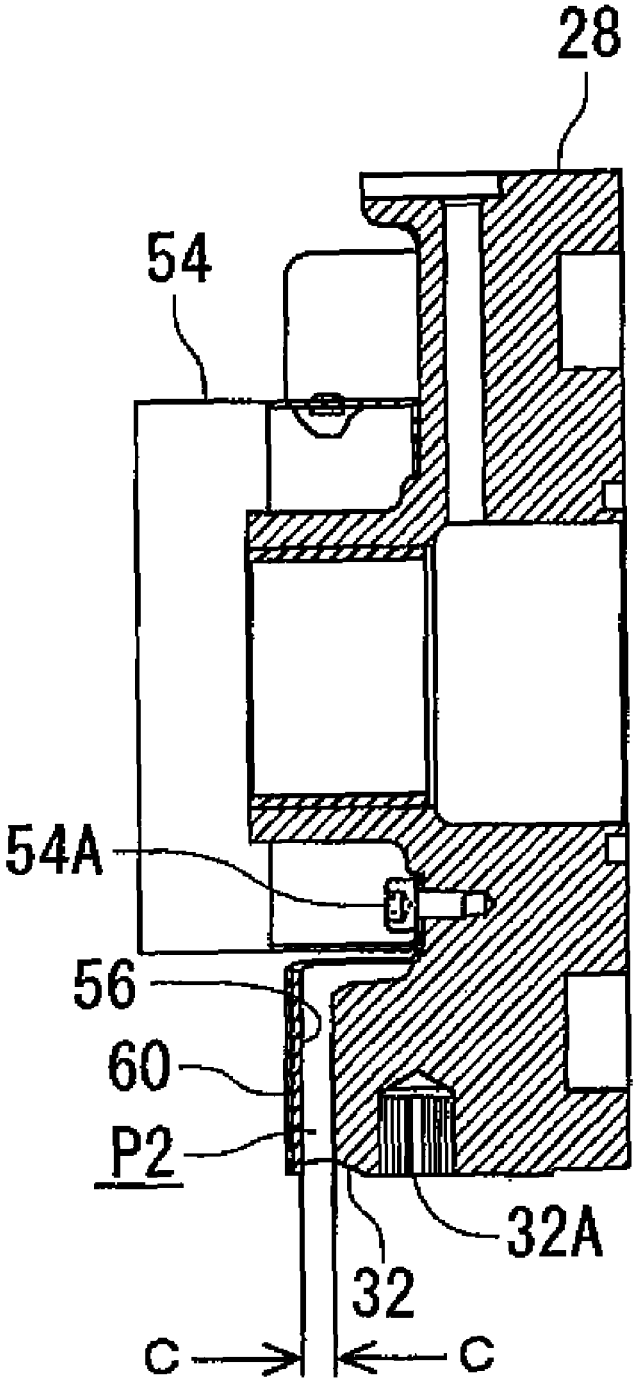
FIG. 21 is a sectional view of the upper support frame constituting the internal high pressure type scroll compressor of FIG. 13 cut along the A-A line.

Next, the bolts 64 are inserted into the fixing holes 62A of the insulating material 60 superimposed on the fixing holes 58A of the oil separation member 56, and screwed into screw holes 33 (only one of them is shown in FIG. 20) provided on both sides of the seat portion 32 of the upper support frame 28, to fix the oil separation member 56 to the upper support frame 28. Then, as shown in FIG. 21, while the oil separation member 56 (including the insulating material 60) is fixed to the upper support frame 28, a gap having a predetermined dimension (about 5 mm in the embodiment) is formed between the main plate portion 56A and the seat portion 32, and a gas path P2 (a part of the gas path P) is formed in the gap (between C and C of FIG. 21).

The oil separation member 56 (including the insulating material 60) is fixed to the upper support frame 28, while one side of the member is arranged in the vicinity of the shield plate 54, the other side of the member is arranged in the vicinity of the inner wall of the container main body 4 and the main plate portion 56A is arranged in the vicinity of the coil end 24. That is, the oil separation member 56 is arranged so as to close the gas path P in the motor element side chamber 43. Consequently, in the middle of the gas path P in the motor element side chamber 43, the gas path P2 formed by the oil separation member 56 and the seat portion 32 is arranged at a predetermined interval.

Next, the flow of the refrigerant gas and the oil of the scroll compressor 1 in this embodiment will schematically be described. The discharge tube 50 of the scroll compressor 1 is connected to the inlet side of an external condenser (not shown), and a suction tube 51 is connected to the outlet side of an external evaporator (not shown). The scroll compressor 1, the condenser, a pressure reducing unit. (not shown) and the evaporator constitute a well known refrigerant circuit. Moreover, the predetermined amount of the refrigerant gas is introduced in this refrigerant circuit. Then, the refrigerant gas discharged from the discharge port 17 of a scroll compression element 10 is discharged into the motor element side chamber 43 through the discharge chamber 42 and the communication path 34 as shown by black arrows in FIG. 7.

Moreover, when a stator 23 (the coil) of the motor element 20 is energized and the rotor 25 starts up to rotate the shaft 22, the orbit scroll 14 is revolved as described above. Specifically, when the shaft 22 starts up, the shaft 22 rotates in a clockwise direction in FIG. 13 to make the revolution of the orbit scroll 14. By the rotation of the orbit scroll 14, the refrigerant gas guided from the suction tube 51 to a suction port 18 is compressed in a compression space 16 of the scroll compression element 10, then discharged from the discharge port 17 to the discharge chamber 42, and flows into the motor element side chamber 43 through the communication path 34.

At this time, the refrigerant gas flows into the guide member 44, collides with a bottom wall 47 to become turbulent, and further collides with the periphery of the guide member 44 (an outer wall 45, side walls 46, 46, the container main body 4, etc.). In consequence, the direction of the refrigerant gas changes to improve an oil separating function.

Moreover, as shown by arrows in FIG. 4, the refrigerant gas which has flowed into the guide member 44 and collided with the bottom wall 47 to become turbulent has its flow direction changed, and flows out of a cutout 49 to collide with a guide wall 48A. The refrigerant gas which has collided with the guide wall 48A is discharged from a gap between the guide wall 48A and the side wall 46 in a vertical direction and the central direction of the fixed scroll 12 (the shaft 22 direction). However, since the upper support frame 28 is disposed above the motor element side chamber 43 and the stator 23 is disposed below the chamber, most of the refrigerant gas advances in the shaft 22 direction.

Furthermore, since the shield plate 54 is provided on the inner side of the guide member 44 (the shaft 22 direction), the refrigerant gas discharged from the gap between the guide wall 48A and the side wall 46 in the shaft 22 direction further collides with the shield plate 54 to become turbulent. When the refrigerant gas collides as much as a plurality of times, the oil separating function improves. In addition, when the refrigerant gas collides as much as the plurality of times, an oil separation efficiency improves, and most of the oil is separated from the refrigerant gas. The refrigerant gas from which the oil has been separated then passes through the gas path P to reach the discharge tube 50, and is discharged externally from the scroll compressor 1 (externally from the sealed container 2) through the discharge tube 50.

Specifically, the refrigerant gas discharged to the gas path P advances in the clockwise direction (a black arrow direction in FIG. 13) through the gas path P, flows out of the gas path P, and is discharged through the discharge tube 50. At this time, all of the refrigerant gas in the gas path P is not discharged through the discharge tube 50 but circulates through the container main body 4 once or several times and is then discharged through the discharge tube 50.

Here, in this embodiment, the oil separation member 56 is fixed to the upper support frame 28 while the oil separation member closes the gas path P as described above. Therefore, in a case where the refrigerant gas discharged through the communication path 34 into the motor element side chamber 43 through the guide member 44 to collide with the shield plate 54 then passes through the gas path P, the refrigerant gas further collides with a main plate portion 56A to become turbulent. After the velocity of the refrigerant gas decreases, the gas flows into the gas path P2. At this time, the plurality of through holes 57, 61 are formed in the main plate portion 56A and both side plate portions 56B of the oil separation member 56 (including the lateral plate portions 60B of the insulating material 60), and any through hole is not formed in the flat plate portion 60A of the insulating material 60. In consequence, the refrigerant gas which has flowed into the gas path P2 is discharged in the next oil separation member 56 direction which is surely the clockwise direction. Consequently, when the refrigerant gas passes through the oil separation member 56, the gas successively passes through the plurality of through holes 61, 57, the gas path P2 and the plurality of through holes 57, 61.

The refrigerant gas which has passed from the communication path 34 through the guide member 44 and which has been discharged to the gas path P alternately passes through the gas path P, the gas path P2 (the oil separation member 56), the gas path P and the gas path P2 (the oil separation member 56) in the clockwise direction, and is then discharged through the discharge tube 50. That is, when the refrigerant gas passes through the gas path P, the refrigerant gas collides with the shield plate 54, then further collides with the plurality of oil separation members 56 and then passes through the plurality of oil separation members 56 (the gas path P2). In consequence, the oil separating function in the oil separation member 56 improves, and most of the oil is separated from the refrigerant gas. Hereinafter, in a case where the refrigerant gas passes between the main plate portion 56A of the oil separation member 56 and the seat portion 32 (passes through the plurality of through holes 61, 57, the gas path P2 and the plurality of through holes 61, 57), it is simply described that the refrigerant gas passes through the oil separation member 56. In a case where the refrigerant gas collides with the oil separation member 56, and becomes turbulent through the plurality of through holes 57, the flow velocity of the refrigerant gas weakens, and the oil is separated from the refrigerant gas, the oil separation of the oil separation member 56 is simply described.

In such a case, while the refrigerant gas in the gas path P is not all discharged through the discharge tube 50 but circulates through the container main body 4 once or several times (the black arrows in FIG. 13), the oil is further separated by each oil separation member 56. In consequence, most of the oil in the refrigerant gas is effectively separated. Then, the oil separated from the refrigerant gas and collected by the guide member 44 drops down from the gap 2 between the bottom wall 47 and the inner surface of the sealed container 2 (including the gap between the bottom wall 47 and the side wall 46) (dotted arrows in FIG. 4). Moreover, the oil collected by the oil separation member 56 also drops down, passes through a gap 23A between the stator 23 and the inner surface of the sealed container 2 to drop down to an oil reservoir 6 on the downside, and is again supplied to the above-mentioned sliding portions by an oil pump 76.

Thus, since the guide member 44 (the gas flow deflection member) for guiding the discharged gas in the shield plate 54 direction is provided at the outlet of the communication path 34 in the same manner as in Embodiment 1 described above, the gas guided from the communication path 34 to the motor element 20 side is blown to the shield plate 54 by the guide member 44. In consequence, the separation of the oil in the gas is promoted, and in general, the amount of the oil to be discharged through the discharge tube 50 can effectively be decreased.

Furthermore, since each oil separation member 56 is attached so as to cover each seat portion 32 in this embodiment, the refrigerant gas guided from the communication path 34 to the motor element 20 side and directed to the discharge tube 50 can smoothly pass through the oil separation members 56 which cover the seat portions 32 of the support frame 28 positioned in the gas path P. Moreover, while the refrigerant gas passes through the oil separation members 56, the oil in the refrigerant gas is separated, so that the amount of the oil to be discharged through the discharge tube 50 can effectively be decreased.

In particular, since the oil separation members 56 are attached to the seat portions 32 by use of the plurality of seat portions 32 of the upper support frame 28, the oil in the refrigerant gas is separated by the plurality of oil separation members 56, and in general, remarkably effective oil separation can be achieved. Moreover, since each of the oil separation members 56 is covered with the air-permeable insulating material 60, insulation between the oil separation members 56 and the motor element 20 can be performed without any trouble.

It is to be noted that in the embodiment, the main plate portion 56A of the oil separation member 56 is formed in parallel with the seat portion 32 of the upper support frame 28, but the present invention is not limited to this example, and the main plate portion 56A and the seat portion 32 on the container main body 4 side may be tilted downwards (the oil reservoir 6 direction) with respect to the shaft 22 side. In this case, since the oil collected by the oil separation members 56 can be guided to the inner surface of the sealed container 2, the oil can smoothly drop down from the gap 23A between the stator 23 and the inner surface of the sealed container 2 to the oil reservoir 6. In consequence, it is possible to securely prevent a disadvantage that the oil collected by the oil separation members 56 drops down from the upper surface of the coil end 24 to the rotor 25 side, again flies and scatters by the rotation of the rotor 25 and is discharged through the discharge tube 50.

Moreover, each oil separation member 56 (including the insulating material 60) is fixed to the upper support frame 28, while one side of the member is arranged in the vicinity of the shield plate 54, the other side of the member is arranged in the vicinity of the inner wall of the container main body 4 and the main plate portion 56A is arranged in the vicinity of the coil end 24 so as to close the gas path P with the gas path P2. However, the present invention is not limited to this example, and the main plate portion 56A of the oil separation member 56 may be disposed away from the coil end 24. That is, when a gap of about ½ to ⅓ of the gap between each seat portion 32 of the upper support frame 28 and the coil end 24 is provided, a high insulating effect between the oil separation member 56 and the motor element 20 can be obtained. When the insulating effect between the oil separation member 56 and the motor element 20 is improved, the insulating material 60 can be omitted. In consequence, the cost increase of the scroll compressor 1 can be suppressed.

Furthermore, an about 150 mesh screen may be interposed between the oil separation member 56 and the insulating material 60. In this case, since the screen has a size of 150 meshes, the mist-like oil included in the refrigerant gas can easily be collected, so that an oil content in the refrigerant gas passing through the gas path P can remarkably effectively be collected.

Additionally, in the present embodiment, the dimension or the shape of each oil separation member 56 has been described, but the dimension or the shape of the oil separation member 56 is not limited to this embodiment, and needless to say, the shape or the dimension may be changed without departing from the scope of the scroll compression element 10. Needless to say, the present invention is not limited only to the above embodiments. Even when the present invention is variously modified without departing from the scope of the present invention, the present invention is effective.

What is claimed is:

1. A scroll compressor comprising, in a sealed container, a scroll compression element; a motor element which drives the scroll compression element; and a support frame having a bearing portion which keeps a shaft of the motor element, the scroll compression element including a fixed scroll in which a spiral lap is vertically provided on the surface of a mirror plate and a orbit scroll which is revolved by the motor element with respect to the fixed scroll to vertically provide a spiral lap on one face of the mirror plate, both the laps being engaged with each other to form a plurality of compression spaces, each compression space being gradually reduced from the outside to the inside so that a gas sucked through a suction tube connected to the compression space of the outer peripheral portion of the scroll compressor is compressed, discharged into the sealed container on a fixed scroll side from the center of the compression element, guided to the motor element side through a communication path provided in the support frame, and discharged through a discharge tube connected to the sealed container in the vicinity of the bearing portion, the scroll compressor further comprising:

a shield plate which extends from the support frame to the motor element side to surround the periphery of the bearing portion; and a guide member provided at an outlet of the communication path to guide the discharged gas in the direction of the shield plate, the guide member having an outer wall, a pair of side walls having attachment walls fixing the guide member to an inner surface of the sealed container, and a bottom wall, with one of the pair of attachment walls having a bent guide wall extending substantially parallel to one of the pair of side walls, a cutout portion provided on the side wall opposite the guide wall, and a predetermined dimension in the side wall left at each end thereof, with a gap provided between the bottom wall and the inner surface of the sealed container, such that oil collected by the guide member drops to the oil reservoir.

2. The scroll compressor according to claim 1, further comprising:

an overcurrent protection apparatus for the motor element attached to a coil end of the motor element, wherein the overcurrent protection apparatus is positioned in a gas path which extends from the communication path outside the shield plate to the discharge tube.

* * * * *